United States Patent [19]

O'Neill

[11] Patent Number: 4,940,526

[45] Date of Patent: Jul. 10, 1990

[54] ELECTROPHORETIC PAINTING APPARATUS

[75] Inventor: Stephen P. O'Neill, Drayton Plains, Mich.

[73] Assignee: General Motors Corporation, Detroit, Mich.

[21] Appl. No.: 434,738

[22] Filed: Nov. 13, 1989

[51] Int. Cl.[5] ..... C25D 13/00; C25D 13/06; C25D 13/12

[52] U.S. Cl. ..... 204/300 EC; 204/299 EC; 204/180.2

[58] Field of Search ..... 204/300 EC, 300 R, 299 EC, 204/181.7, 180.2, 180.7, 181.1, 181.2, 181.3

[56] References Cited

U.S. PATENT DOCUMENTS

| | | | |
|---|---|---|---|
| 4,210,505 | 7/1980 | Todoroki et al. | 204/181 |
| 4,486,284 | 12/1984 | Mori et al. | 204/181 |
| 4,824,538 | 4/1989 | Hibino et al. | 204/299 EC |
| 4,844,783 | 7/1989 | Takahashi et al. | 204/299 EC |

FOREIGN PATENT DOCUMENTS

DE 2935061 9/1982 Fed. Rep. of Germany .

OTHER PUBLICATIONS

"Design Considerations for the Use of PPG Uni-Prime® and Cathodic Electrocoat in Body Systems", p. 79, teaching materials from a Feb. 2-3, 1989 course offered by Pittsburgh Paint and Glass.

Wismer et al., "Cathodic Electrodeposition", *Journal of Coatings Technology,* vol. 54, No. 688, May 1982, pp. 35-44.

*Primary Examiner*—John F. Niebling
*Assistant Examiner*—John S. Starsiak, Jr.
*Attorney, Agent, or Firm*—Lawrence B. Plant

[57] ABSTRACT

An apparatus is provided for electrophoretically depositing paint upon a cathodic substrate, e.g., a truck body, comprising a tank having introductory and exit regions, with a coating region positioned therebetween. The coating region comprises two or more primary anode banks of different electrical potential, the potential of the banks nearer the exit region being successively greater than those of preceding banks. An auxiliary anode bank is positioned between primary banks of different potential, the auxiliary bank being maintained at approximately the same electrical potential as the adjacent lower potential primary bank. Diodes are provided to prevent current flow between lower potential primary anodes, and between auxiliary anodes, through conductor means electrically coupling the anodes together. The subject apparatus reduces current flow from a higher potential bank to a lower potential bank, thus reducing paint deposition upon and subsequent fouling of the anodes of the latter.

11 Claims, 4 Drawing Sheets

5

7

ELECTROPHORETIC PAINTING APPARATUS

This invention relates to an apparatus for electrophoretically painting an electrically conductive substrate. More specifically, this invention relates to an apparatus wherein current flow from a higher potential anode bank to an adjacent lower potential anode bank is minimized, while efficient utilization of coating facilities is ensured.

BACKGROUND OF INVENTION

Electrophoretic deposition is a well known process useful to paint a variety of conductive substrates. Through electrophoretic deposition, automobile and truck bodies may be primed prior to topcoating. Electrophoretic deposition technology is discussed in a variety of publications including "Cathodic Electrodeposition", Journal of Coatings Technology, Volume 54, No. 688, pages 35–44 (May 1982). Briefly, a direct current is passed through an aqueous suspension of positively charged paint particles. Under the influence of the applied current, the charged paint particles migrate to and precipitate upon a conductive substrate of opposing charge. In cathodic and anodic electrophoretic painting, precipitation occurs on cathodic and anodic substrates, respectively.

Cathodic painting processes are now seemingly more popular than their anodic counterparts. In cathodic electrophoretic painting processes, paint particles are suspended in an aqueous carrier. Upon the passage of electrical current therethrough, water is electrolyzed. Hydroxyl ions formed at the cathode establish an alkaline diffusion layer contiguous therewith. The alkalinity of the diffusion layer is proportional to the cathode current density. Under the influence of the applied voltage, the positively charged paint particles electrophoretically migrate to the cathode and into the alkaline diffusion layer. If the cathode current density is sufficiently high, hydroxyl ions produced thereby raise the pH of the diffusion layer enough to ensure chemical reaction between the charged paint particles and the hydroxyl ions, whereby the former precipitate upon the cathodic substrate.

Cathodic electrophoretic painting apparatus used for large substrates such as truck bodies typically comprise an elongated, e.g., ca. 120 ft, tank for containing the paint bath. The substrate is submerged in the bath and conveyed along the length of the tank, through introductory, coating, and exit regions thereof. The introductory region, having no anodes, typically permits complete immersion of the substrate before its admission to the coating region. Passage through the introductory region lessens the condition known as hash marking, i.e., an uneven coating attributed to sudden exposure of the substrate to a high electrical potential difference.

The coating region of the tank, wherein painting occurs, typically comprises at least two distinct coating zones or electrode banks. Each bank comprises two opposing arrays of one or more anodes aligned along the longitudinal sides of the tank. Substrates are conveyed through the coating region between such opposing arrays. Each successive bank in the direction of substrate conveyance is maintained at a higher electrical potential than each preceding bank. For ease of handling and maintenance, such systems commonly use large, planar anodes, e.g., flat plate or box electrodes.

Typical planar anodes for painting large objects, e.g., truck bodies, extend approximately three feet along the longitudinal sides of the tank in the direction of substrate conveyance and are typically approximately eight feet long, i.e., high. Planar anodes extend downward to at least the lower portion of the substrate, may be spaced approximately six inches apart within each coating zone and project a small distance, e.g. three inches, above the bath such that virtually the entire frontal face i.e., about 24 $ft^2$, confronting the cathode, e.g. a car body, is effectively used.

Rather than using relatively few large planar anodes, some manufacturers have used a multitude of smaller anodes, e.g., two inch diameter tubes, continuously spaced from six to twenty-four inches apart along the entire length of the coating region, the degree of spacing increasing along the line of substrate conveyance.

Regardless of the type of anode utilized, the anodes and substrate are electrically coupled to a power source and to a ground by appropriate electrical conductors, e.g., bus bars and/or cables. As indicated, anode banks are maintained at successively greater electrical potentials along the line of substrate conveyance to compensate for the increased resistivity of the applied coating as it is deposited. This electrical potential gradient permits thicker, uniform paint deposition in a shorter tank than possible with single potential/zone systems.

While multi-zone cathodic painting represents a valuable coating technology, it heretofore has been encumbered by reverse current flow, the tendency of current to flow from a higher potential bank to the adjacent lower potential bank, rather than solely to the substrate. Such misguided current can lead to paint deposition on the lower potential bank anodes, and the general fouling thereof. Reverse current flow is particularly acute as a batch of substrates enters a substrate-free tank when the resistance between a higher potential bank and an adjacent lower potential bank is less than that between the higher potential bank and the entering substrates.

As will be discussed in conjunction with the appended Figures, it is known that reverse current flow may be reduced by electrically disconnecting, without physically removing, one or more of the lower potential anodes immediately adjacent the higher potential bank. Electrical disconnection precludes current flow from the disconnected lower potential anode(s) to other lower potential anodes through common conductors. Nonetheless, current can pass from the higher potential anode to the lower potential anode adjacent the disconnected anode either through the relatively resistive coating bath, i.e. and circumvent the disconnected anode, or be shunted through the electrically detached low resistance anode en route to the adjacent lower potential anode.

The Figures will further illustrate the known practice of providing a relatively large gap between adjacent banks of different electrical potential to more effectively curtail reverse current flow therebetween. A large gap may be formed by physically removing one or more anodes adjacent the high potential-low potential interface. The larger the gap provided, the higher the resistance between the adjacent banks. By providing a sufficiently large gap between adjacent banks of different potential, significant current flow therebetween, and concomitant lower potential anode fouling, can be reduced. At least one prominent electrophoretic paint system supplier advises that if adjacent banks differ in electrical potential by more than 75 volts, at least a two-cell length gap should be provided, a cell length being the anode dimension, e.g., the anode width, measured along the line of substrate conveyance plus the gap length between such anode and the next adjacent anode in the same bank. If adjacent banks differ in electrical potential by more than 100 volts, the supplier advises the provision of at least a three-cell length gap.

While providing a suitable gap between higher and lower potential zones reduces the magnitude of reverse current flow, the strategy suffers attendant disadvantages, especially when the recommended gaps are large. As the substrate passes the gap, the electrical current reaching it drops, resulting in slower paint deposition. The magnitude of current reduction and the length of time it exists are related to the gap length and the rate of substrate conveyance. Thus, providing a high resistance interzone gap requires either increasing the length of the tank and the coating region therein to ensure equivalent coating deposition at a comparable rate of substrate conveyance, or accepting a reduced effective immersion time of the substrate. The former leads to increased bath volume, tank floor space requirements, and actual substrate immersion time, which translates to correspondingly greater process costs. The latter leads to a non-optimal coating situation, i.e., fewer electrodes are available for electrophoretic deposition, resulting in thinner coatings.

Finally, it is known that the interzone gap may be reduced by interposing a diode between each of the anodes of the adjacent lower potential bank and their connected power source, averting current backflow therebetween. It is known that proper diode placement permits a one-cell interzone gap between adjacent banks. This technique nonetheless still involves an interzone gap devoid of anodes and associated electrochemical activity.

Manufacturers would find great advantage in an electrophoretic painting apparatus wherein paint deposition upon lower voltage large-faced anodes is minimized or precluded without interposing significant electrochemically inactive gaps between adjacent high and low potential anode banks. It would be desirable for such an apparatus to enjoy a coating region substantially filled with anodes, each contributing to the electrophoretic deposition process. Such continuous anode placement would allow a shorter tank, requiring less floor space and paint bath, and would permit shorter substrate residence times for the same coating thickness. Such an apparatus would afford significant financial savings.

Accordingly, it is an object of this invention to provide a multi-zone electrophoretic painting apparatus utilizing primarily large-faced planar electrodes, and having a coating region which is electrochemically active along substantially its entire length, while allowing negligible reverse current flow through the lower potential anodes.

This and other objects and advantages of the present invention will become more readily apparent to one skilled in the art through the description thereof which follows.

SUMMARY OF THE INVENTION

In accordance with a preferred embodiment of the invention, an electrophoretic painting apparatus is provided having an elongated tank for containing an aqueous paint suspension. The tank has anode-free introductory and exit regions at opposite ends thereof, and a coating region therebetween. Within the coating region, a substantially continuous array of anodes is positioned along the longitudinal walls of the tank. The coating region comprises at least two primary anode banks or zones, each comprising at least one large-faced planar anode extending into the tank and having a major dimension in the direction of substrate conveyance. As the substrate is conveyed through the tank, it successively passes by each of the longitudinally aligned banks. The anodes and substrate are coupled by electrical conductors with a DC power source, e.g., a rectifier or generator, to establish the different electrical potentials and current flow requisite for coating. The electrical potentials of the anodes are established such that each successive primary bank in the direction of substrate conveyance is greater than that of the preceding bank. A diode is positioned between each anode of the lower potential banks and its associated power source to preclude current flow from such anodes between anodes in the same bank.

A gap is provided between adjacent primary banks or zones of different voltage suitable to restrict current flow therebetween enough to preclude paint deposition on the lower potential anode. The length of the interzone gap is preferably equal to at least approximately one-cell width, as defined above. A plurality of significantly smaller auxiliary anodes are provided within the interzone gap. Such auxiliary anodes are coupled by electrical conductors into clusters of equipotential anodes. While the auxiliary anodes are each significantly smaller than the primary anodes, the collective surface area of the auxiliary anodes within a given interzone gap preferably equals at least about the effective surface area of planar primary anodes that could otherwise occupy the gap. Auxiliary anodes are separated one from the others by the relatively resistive painting bath. The plurality of bath-filled gaps between the several auxiliary electrodes significantly inhibits lateral current flow from one auxiliary anode to the next and to the adjacent lower potential primary anode.

The number of auxiliary anodes required varies with their size and the size of the interzone gap, which in turn is dictated by the potential difference between the adjacent primary anode banks. The number should be selected such that the current density at the face of the auxiliary anodes does not exceed (i) the current density of the lower potential primary anodes and (ii) the current density at which significant auxiliary anode erosion occurs. Auxiliary anode current densities between about 3 and 5 amps/ft$^2$ are preferred. Preferably, at least four, and more preferably, at least five auxiliary anodes will be positioned in the space normally occupied by one planar primary electrode. Hence, each auxiliary anode will have a surface area of no more than about 25 percent that of a lower potential primary anode.

The auxiliary anodes are maintained at essentially the same electrical potential as the lower potential adjacent bank. This is preferably accomplished by electrically coupling the auxiliary anodes and the primary anodes of the adjacent lower potential bank to a common power supply. In the alternative, separate power supplies and connections may be used. A diode is interposed between each auxiliary anode and its power source to preclude current flow between the auxiliary anodes within the same auxiliary anode bank. The several auxiliary anodes, the paint-filled gaps therebetween and the diodes associated therewith prevent significant lateral current flow and fouling of the lower potential primary anodes. Moreover, the auxiliary anodes contribute to the deposition process in a region of the tank, i.e., the interzone gap, which heretofore was essentially wasted space in terms of coating.

These and other concomitant features and advantages of the present invention will become apparent from the following detailed description of the reverse current flow problem and of a preferred apparatus for overcoming that problem, which is given in conjunction with the appended drawings in which.

DETAILED DESCRIPTION OF THE REVERSE CURRENT FLOW PROBLEM AND A PREFERRED EMBODIMENT OF THE INVENTION

Reverse current flow may take several pathways, each of which will be discussed in conjunction with the appended drawings. For convenience, electrodes aligned along one longitudinal side of the tank are at times discussed independently of those aligned along the opposing longitudinal side, and vice versa.

Figure 2:
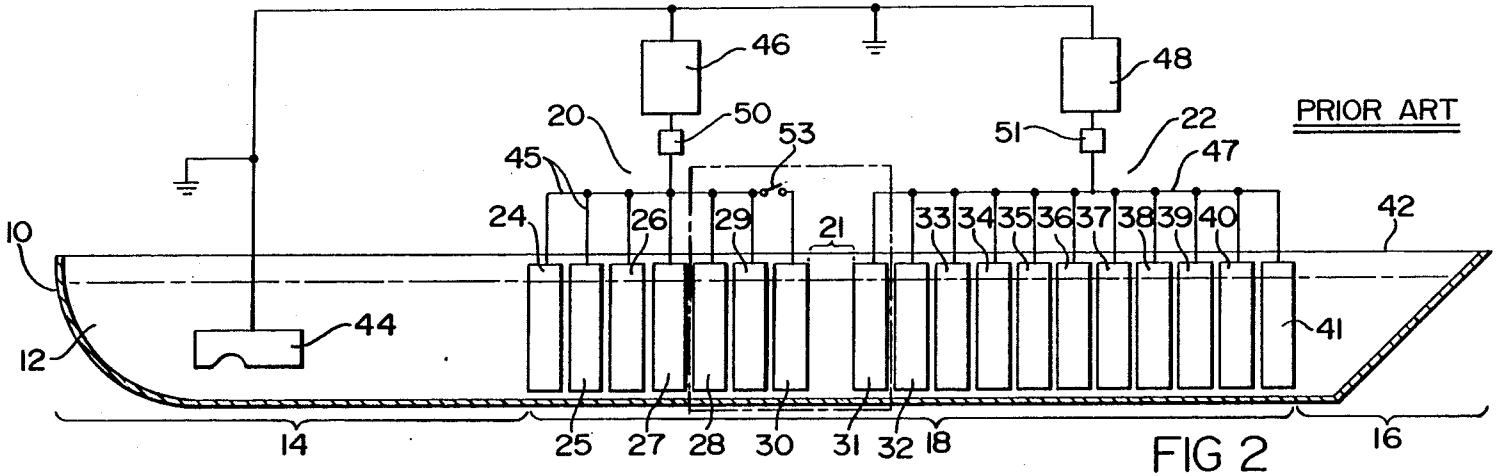
PRIOR ART FIG 2
FIG. 2 is a schematic side sectional view, taken in the direction 2—2 of FIG. 1.
Figure 1:
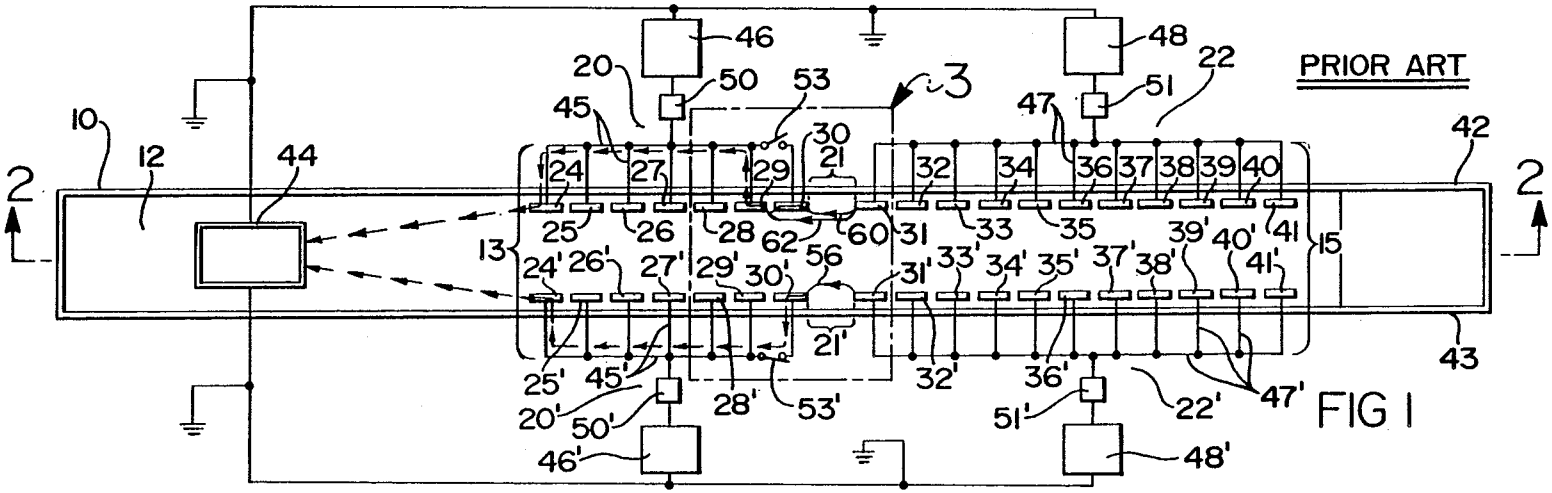
PRIOR ART FIG 1
FIG. 1 is a schematic top plan view of an electrophoretic coating apparatus for illustrating the reverse current flow problem.
Figure 3:
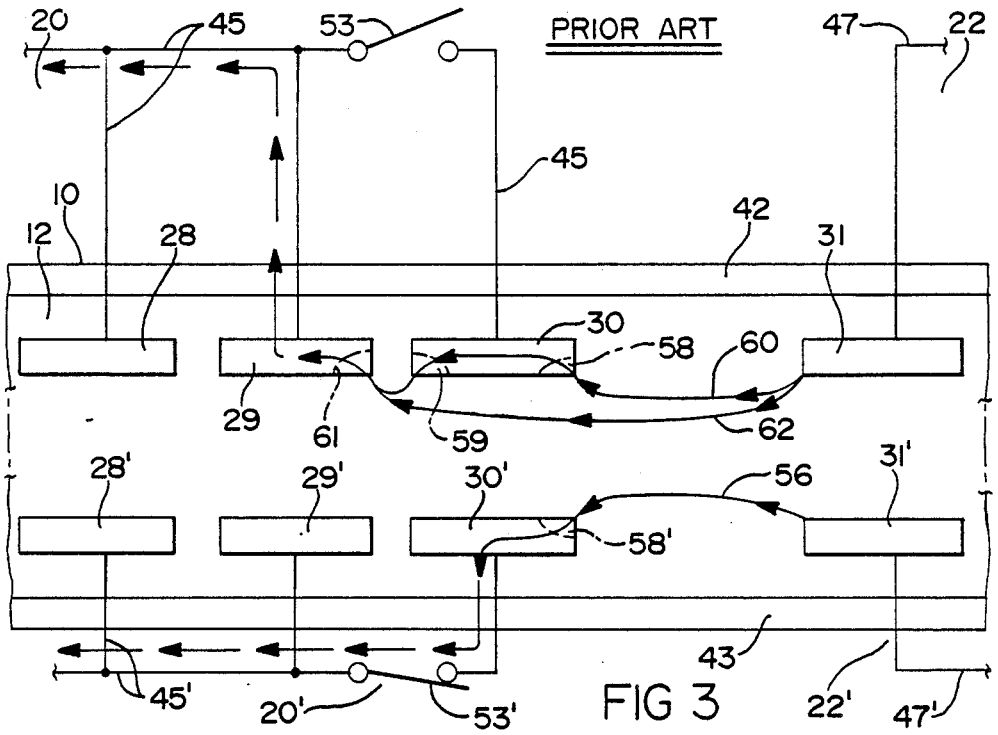
FIG. 3 is an enlarged schematic top plan view of the region 3 indicated by broken lines in FIGS. 1 and 2.

Referring to the drawings, wherein common reference numerals indicate common parts, FIGS. 1–3 illustrate the effect of electrically disconnecting an anode on reverse current flow. An elongated tank 10 is provided for containing electrophoretic deposition bath 12. Defined within tank 10 are introductory region 14 and exit region 16, with coating region 18 positioned therebetween. Coating region 18 comprises at least two anodic banks 13 and 15. Bank 13 comprises two opposing arrays of anodes, 20 and 20′ longitudinally aligned along sides 42 and 43 of tank 10, respectively. Arrays 20 and 20′ are maintained at the same electrical potential. Bank 15 comprises two opposing arrays of anodes, 22 and 22′ longitudinally aligned along sides 42 and 43 of tank 10, respectively. Arrays 22 and 22′ are each maintained at the same electrical potential, which potential is higher than that of arrays 20 and 20′. Arrays 20 and 20′ comprise a plurality of lower potential primary anodes 24–30, and 24′–30′, respectively. Arrays 22 and 22′ comprise a plurality of higher potential primary anodes 31–41 and 31′–41′, respectively. Anodes 24–41 and 24′–41′ are longitudinally aligned along walls 42 and 43 of tank 10, respectively. Substrate 44 is conveyed therebetween, from introductory region 14 to exit region 16. Arrays 20 and 20′ are separated from arrays 22 and 22′ by one-cell interzone gaps 21 and 21′, respectively. Primary anodes 24–30 are coupled to DC power source 46 by electrical conductors 45. Similarly, anodes 24′–30′, 31–41, and 31′–41′ are connected by electrical conductors 45′, 47, and 47′ respectively to DC power sources 46′, 48, and 48′, respectively. Current transducer 50, e.g. a Hall device, measures current flow from DC power source 46 to array 20. Likewise, transducers 50′, 51, and 51′ measure current flow from DC power sources 46′, 48, 48′ to arrays 20′, 22, and 22′, respectively. Switches 53 and 53′ are provided for electrically disconnecting anodes 30 and 30′ from DC power sources 46 and 46′, respectively.

Reverse current may flow in accordance with pathway 56. Referring to arrays 20′, and 22′, longitudinally aligned along side 43 of tank 10, the last anode 30′ of the relatively low electrical potential array 20′ lies adjacent the first anode 31′ of the higher potential bank 22′. In accordance with pathway 56, current flows across electrophoretic deposition bath 12 in gap 21′ from anode 31′ to the region 58′ of anode 30′. The received current flows through the electrical conductors 45′ from anode 30′ to anode 24′, and eventually to substrate 44.

It is known that reverse current flow may be somewhat decreased by opening switch 53′, electrically disconnecting anode 30′ from power source 46′ and from lower potential anodes 24′–29′. For convenience, the effect of such electrical disconnection on these pathways is illustrated with respect to arrays 20 and 22, aligned along longitudinal side 42 of tank 10. In accordance with pathway 60, current flows from higher potential anode 31 to region 58 of anode 30. The electrical disconnection of anode 30 from anodes 24–29, e.g., by opening switch 53, prohibits current flow from anode 30 through conductors 45. However, current can nonetheless flow through the conductive material of anode 30, exit region 59 of anode 30, and pass through the resistive bath separating anodes 29 and 30 into region 61 of anode 29. Current may thereafter flow from anode 29, through electrical conductors 45 to anode 24, and, flowing therethrough, to substrate 44. In accordance with more resistive pathway 62, current flows from anode 31 to the region 61 of anode 29, circumventing intermediate anode 30. Current flows through the conductive material of anode 29, passes through conductors 45 to anode 24, and passes through bath 12 to substrate 44. Thus, since reverse current flow is, in part, a direct result of lateral current flow through the conductive material of anodes 24–30 and through the relatively resistive intermediate painting bath 12, it cannot be eliminated by electrically disconnecting the lower potential anode adjacent a high potential-low potential interface.

Figure 5:
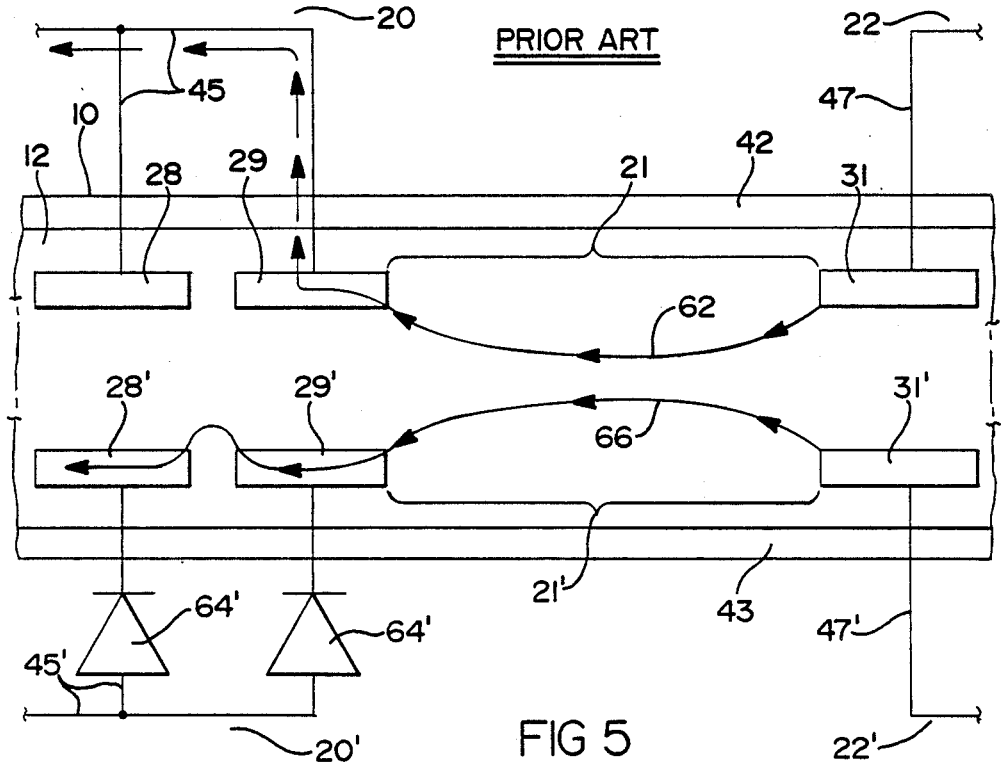
FIG. 5 is an enlarged schematic top plan view of the region 5 indicated by broken lines in FIG. 4.
Figure 4:
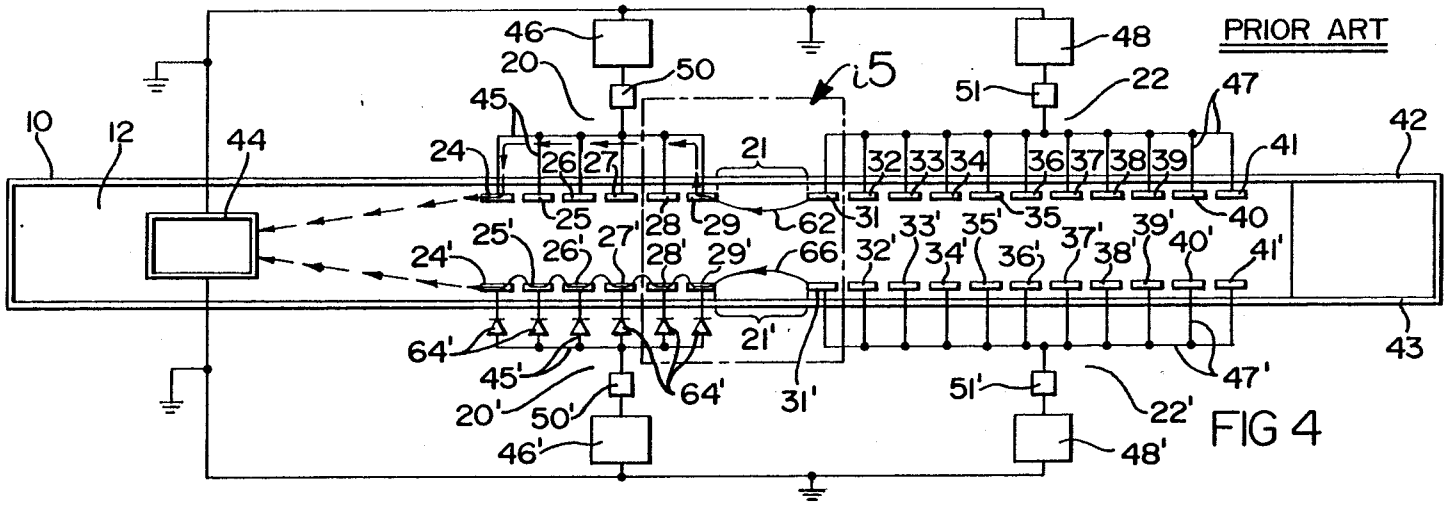
PRIOR ART FIG 4
FIG. 4 is a schematic side top plan view of an electrophoretic coating apparatus of the prior art.

FIGS. 4 and 5 illustrate two additional prior art solutions to the problem of reverse current flow. Therein, anodes 30 and 30′ of FIGS. 1–3 have been physically removed from tank 10, eliminating them as conductive shunts and significantly increasing interzone gaps 21 and 21′. As illustrated with respect to arrays 20 and 22 longitudinally aligned along side 42 of tank 10, current can flow from anode 31 to anode 29 only through highly resistive pathway 62, since removed anode 30 of FIGS. 1–3 is unavailable for shunting therethrough, i.e., physically removing anode 30 of FIGS. 1–3 eliminates the current path 60 thereof. However, adequate reverse current flow preclusion is obtained at the expense of anode surface area, i.e. anodes 30 and 30′ of FIGS. 1–3 are no longer available for electrophoretically painting substrate 44. Thus, when the conditions that cause reverse current flow are removed, e.g., when the resistance between adjacent higher and lower potential anode banks is greater than that between the higher potential bank and the substrates, the fewer anodes provide lower than total optimum current flow to the substrates.

As illustrated by arrays 20' and 22' of FIGS. 4–5, it is known to reduce reverse current flow by providing unidirectional conductors, e.g., diodes 64' electrically intermediate each of anodes 24'–29' and power source 46', such that current flow from anode 29' to any of anodes 24'–28' through conductors 45' is prevented. However, as indicated by pathway 66, current can nonetheless flow from anode 31' to and through the conductive material of anode 29'. Hence, though diodes 64' preclude reverse current flow through conductors 45', current still flows through alternating portions of the resistive bath and conductive anodes to substrate 44. Diodes 64, by discouraging reverse current flow, permit a smaller interzone gap 21 than otherwise possible.

Figure 6:
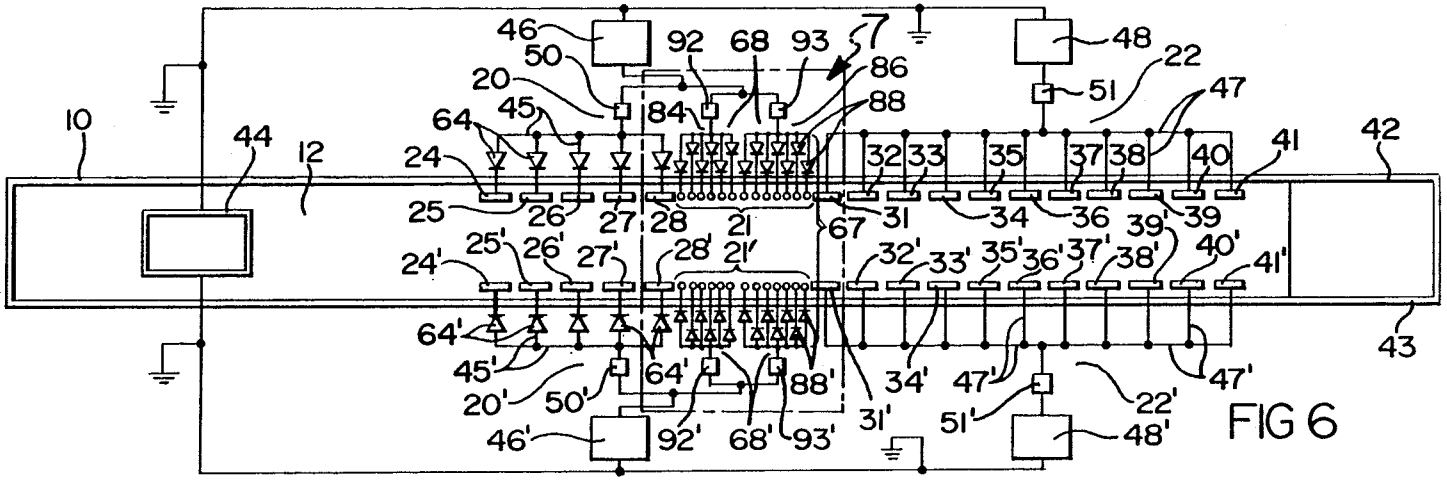
FIG. 6 is a schematic top plan view of an electrophoretic coating apparatus of the subject invention.
Figure 7:
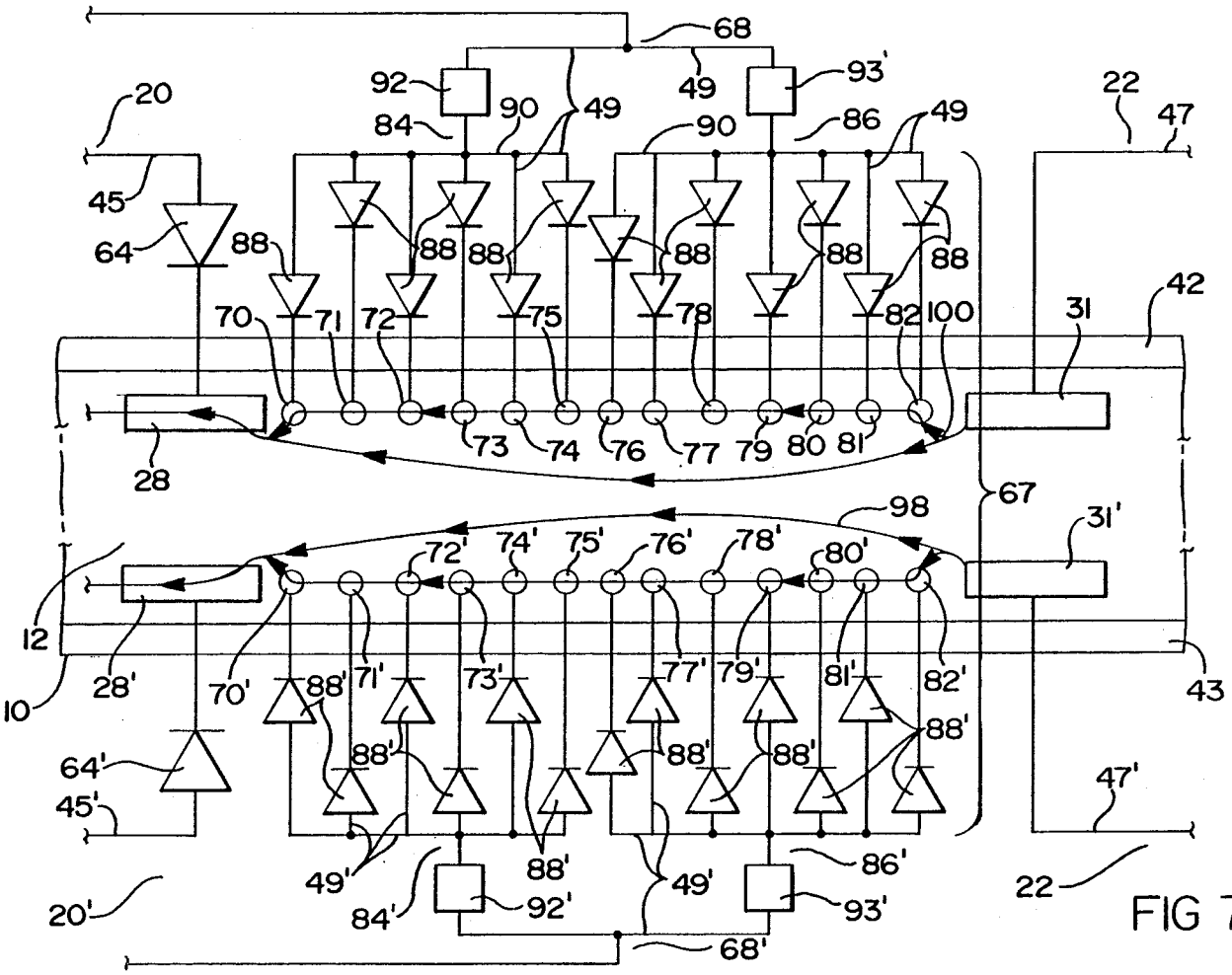
FIG. 7 is an enlarged schematic top plan view of the region 7 indicated by broken lines in FIG. 6.

FIGS. 6 and 7 illustrate a preferred embodiment of the subject invention. Enlarged interzone gaps 21 and 21' are provided by removing anodes 29, 29', 30, and 30' from their locations in FIGS. 1–3. Auxiliary anodic bank 67 is interposed within the enlarged gaps 21 and 21'. Bank 67 comprises two opposing arrays of auxiliary anodes, 68 and 68' longitudinally aligned along sides 42 and 43 of tank 10, respectively. Arrays 68 and 68' comprise a plurality of auxiliary anodes 70–82 and 70'–82' (see FIG. 7), respectively. Anodes 70–82 of array 68 are electrically coupled into clusters 84 and 86; anodes 70'–82' of array 68' are likewise electrically coupled into clusters 84' and 86'. The collective surface area of the anodes within each cluster is approximately equal to that of the frontal face of a flat plate anode, e.g. 28 or 28' (e.g., 24 $ft^2$ in the example). Each auxiliary anode 70–82 is connected by electrical conductors 49 to DC power source 46. Likewise, each auxiliary anode 70'–82' is connected by electrical conductors 49' to DC power source 46'. Diodes 88 are interposed between each auxiliary anode 70–82 and power source 46, such that reverse current flow through conductors 49 between auxiliary anodes is prevented. Diodes 88' are similarly provided between each auxiliary anode 70'–82' and power source 46'. Diodes 64 are interposed between each primary anode 24–28 and power source 46, preventing reverse current flow through conductors 45 between the anodes of array 20. Diodes 64' are similarly provided between each primary anode 24'–28' and power source 46'. Current transducers 92 and 93 are provided to measure the current flow from DC power source 46 to clusters 84 and 86, respectively. Current transducers 92' and 93' are likewise provided to measure the current flow from DC power source 46' to clusters 84' and 86', respectively.

The installation of auxiliary anodes 70–82 and diodes 64 and 88 reduce reverse current flow as described hereafter with respect to arrays 20, 68 and 22 longitudinally aligned along side 42 of tank 10. The majority of reverse current flow from higher potential anode 31 to lower potential anode 28 will occur in accordance with the least resistive pathway 100, i.e., rather than passing through more resistive path 98. Current, leaving anode 31, passes through the resistive paint bath 12 to auxiliary anode 82. Diodes 88 prohibit current flow from anode 82 to other auxiliary anodes through conductors 49. Current flows from anode 82, passing through the resistive bath 12 to anode 81. The process must be repeated twelve times before current reaches anode 28. Diodes 64 of array 20 direct the majority of reverse current flow from anode 28 to anode 24 by shunting it through intermediate anodes 25–27. By discouraging reverse current flow, paint deposition upon anode 28 is reduced. Equally important, when the conditions that cause reverse current flow are removed, auxiliary anodes 70–82 (and 70'–82') are available for the electrophoretic painting of substrate 44. Thus, the subject invention increases the electrical length of the tank, reduces deposition on lower voltage anodes as a result of reverse current flow, and increases anode life.

In a preferred embodiment, auxiliary anodes take the form of long strips or tubes, each having a diode electrically intermediate it and its power source. Preferred tubes are hollow, and open-ended to preclude floating. Closed-bottom hollow tubes may be utilized, provided the mass thereof is sufficient to preclude floating. Solid tubes of sufficient mass are also satisfactory. Tubular, rather than thin flat-plate auxiliary anodes are preferred. In this regard, while the plate-like anodes generally utilized in the primary anode banks have only one planar face generally available for coating, i.e., the face confronting the substrate, the entire surface of each tubular anode is substantially available for coating.

The following example is offered for the purpose of explanation rather than limitation.

EXAMPLE

An approximately 120.5 foot elongated tank is provided for containing a suitable cathodic electrophoretic paint bath, such as the formulation designated as PPG ED3150, commercially available from PPG Industries Inc. The tank is provided with a 38 foot introductory region, a 16 foot exit region, and a 66.5 foot coating region therebetween. The coating region comprises two primary anode banks. The primary bank most proximate the introductory region contains two opposing arrays of 5 anodes, each anode maintained at approximately 325 volts DC. The primary bank most proximate the exit region contains two opposing arrays of 10 anodes, each anode maintained at approximately 365 volts DC. Each anode of the two primary banks is approximately 40 inches wide, 8 feet high, and 4 inches thick and made of 316 stainless steel. Each primary anode is separated from adjacent anodes within the same array by a distance of approximately 6 inches. The anodes of each array are electrically coupled by, e.g., a busbar. A diode rated at 300 amps and 1000 PIV is electrically intermediate each lower potential primary anode and the connected busbar.

Interposed between the two primary banks is an auxiliary anode bank comprising two opposing arrays of 13 auxiliary anodes. Each auxiliary anode is maintained at approximately 325 volts DC. The thirteen auxiliary anodes of each array are coupled by conductors into two clusters of six and seven anodes, respectively by, e.g., busbars. A diode rated at 30–40 amps and 400 PIV is electrically intermediate each auxiliary anode and the connected busbar. Each auxiliary anode is approximately 2 inches in diameter and 8 feet long. Auxiliary anodes may be formed from 1.5 inch I.D. schedule 80 stainless steel pipe. Each auxiliary anode is separated from adjacent auxiliary anodes within the same array by a distance of approximately 6 inches. Nine inch gaps exist between the primary arrays and the auxiliary arrays positioned therebetween.

Cathodic truck bodies are successively conveyed through the tank at approximately 34.6 feet/minute. Each body is immersed for approximately 2.2 minutes. The apparatus is capable of coating approximately 76.9 bodies per hour.

For simplicity, the subject invention has been presented as embodied in a cathodic electrophoretic deposition apparatus. It should be recognized, however, that this technology is equally applicable to an anodic electrophoretic deposition apparatus. In a comparable anodic system, the polarities of the power sources and of the diodes are reversed. Further, electrical modeling suggests that the concepts presented here for two zone tanks apply to any multi-zone tank, regardless of the number of zones.

While the subject invention has been described in terms of the preferred embodiments thereof, various modifications within the spirit and scope of the appended claims are expected and encouraged.

The embodiments of the invention in which an exclusive property or privilege is claimed are defined as follows:

1. An apparatus for electrophoretically depositing paint onto the surface of a substrate upon the application of a direct current thereto as said substrate is conveyed along the length of said apparatus comprising:

an elongated tank for containing a bath of said paint, said tank having an introductory region for admitting said substrate and an exit region for discharging said substrate, said tank being in part defined by two opposing longitudinal sides;

a coating region situated between said introductory and exit regions, said coating region comprising:

at least two primary electrode banks aligned in a first direction of said conveyance and operating at different electrical potentials, said banks each comprising two opposing arrays of electrodes aligned along said sides, said arrays comprising at least one electrode for immersion in said bath, each said electrode having a width extending in said first direction, a length extending in a second direction perpendicular to said first direction, and a frontal surface area equal to the product of said width and said length, wherein each higher potential array is separated from an adjacent lower potential array by a gap greater than said width and sufficient to substantially preclude flow of paint-depositing current therebetween through said bath, and a plurality of spaced-apart auxiliary electrodes substantially filling each said gap, said auxiliary electrodes each (i) having a second surface area which is no greater than about 25 percent of said frontal surface area, and (ii) being at substantially the same potential as said lower potential bank;

a power source for establishing electrical potentials between said banks and said substrate such that the potential of each successive bank is greater than that of the substrate and the preceding bank in said direction;

electrical conducting means connecting said power source and said electrodes;

first diode means electrically interposed between each electrode of said adjacent lower potential bank and said power source, precluding direct current flow from each such electrode to any other said electrode within the same said array through said conducting means; and second diode means electrically interposed between each of said auxiliary electrodes and said power source precluding direct current flow between auxiliary electrodes within the same said gap through said conducting means;

whereby said second diode means, in cooperation with said auxiliary electrodes, allow substantially continuous electrode placement within said coating region while restricting current flow from said higher potential bank to said adjacent lower potential bank to levels below which said paint will deposit on said lower potential bank.

2. An electrophoretic deposition apparatus as recited in claim 1 wherein said substrate is cathodic relative to said electrodes.

3. A cathodic electrophoretic deposition apparatus as recited in claim 2 wherein each array of said lower potential bank comprises at least two electrodes, each of which is at substantially the same electrical potential as the other electrodes within the same bank.

4. A cathodic electrophoretic deposition apparatus as recited in claim 3 wherein each of said bank electrodes is flat, each of said auxiliary electrodes is substantially cylindrical, and said second surface area is the product of the length of said auxiliary anode taken in said second direction and the outside circumference of said auxiliary anode.

5. A cathodic electrophoretic deposition apparatus as recited in claim 4 wherein said cylindrical auxiliary electrodes are tubular.

6. A cathodic electrophoretic deposition apparatus according to claim 4 wherein said conductor means couples said auxiliary electrodes together in clusters such that the nominal current density of the electrodes in each cluster is approximately equal to the current density of each of said flat electrodes at the same potential.

7. A cathodic electrophoretic deposition apparatus according to claim 4 wherein said conductor means couple each of said auxiliary electrodes within an array together in clusters such that the total surface area of all the electrodes in each cluster is approximately equal to said frontal surface area.

8. Apparatus for electrophoretically painting the surface of a cathodic substrate upon the application of a direct current thereto as said substrate is conveyed along the length of said apparatus comprising:

an elongated tank for containing a bath of said paint, said tank having an introductory region for admitting said substrate and an exit region for discharging said substrate, said tank in part defined by two longitudinal sides;

a coating region situated between said introductory and exit regions, said coating region comprising:

at least two primary anode banks aligned in the direction of said conveyance and operating at different electrical potentials, said banks each comprising two opposing arrays of electrodes aligned along said sides, each of said arrays comprising at least one substantially flat, plate-like anode having a frontal area confronting said substrate and wherein each higher potential array is separated from an adjacent lower potential array by a gap sufficient to substantially preclude flow of paint-depositing current therebetween through said bath, and a plurality of spaced-apart, substantially cylindrical auxiliary anodes substantially filling said gap, said auxiliary anodes each (i) having a surface area which is substantially less than said frontal area, and (ii) being at substantially the same potential as said adjacent lower potential bank; and a power source for establishing electrical potentials between said banks and said substrate such that the potential of each successive bank is greater than that of the substrate and the preceding bank in said direction;

electrical conducting means interconnecting said power source, said anodes, and said substrate, said conducting means being so arranged as to couple said auxiliary anodes into at least one cluster;

first diode means interposed between each anode of said adjacent lower potential bank and said power source, precluding direct current flow from each such anode to any other said anode within the same said lower potential bank through said conducting means; and second diode means interposed between each of said auxiliary anodes and said power source precluding direct current flow from between auxiliary anodes within the same said gap through said conducting means;

whereby said second diode means, in cooperation with said auxiliary anodes, allow substantially continuous electrode placement within said coating region while restricting current flow from said higher potential bank to said adjacent lower potential bank to levels below which said paint will deposit on said lower potential bank.

9. Apparatus according to claim 8 wherein:

said lower potential bank comprises at least two anodes, each of which is at substantially the same electrical potential as the other anodes within the same bank.

10. Apparatus for electrophoretically painting a substrate comprising:

an elongated tank for containing a bath for depositing paint onto said substrate at successively higher voltages as said substrate travels the length of said tank beneath said bath, said tank having an entrance at one end for admitting said substrate into said bath and an exit at the opposite end for discharging said substrate from said bath;

a plurality of successive deposition zones positioned along the length of said tank, said zones each operating at an electrical potential higher than that of said substrate and any preceding zone and comprising at least one substantially planar primary electrode having a first effective surface area and a major dimension in the direction of said substrate travel;

a gap between each successive zone, said gap being at least equal to about said major dimension;

a plurality of spaced-apart auxiliary electrodes substantially filling said gap and being at substantially the same electrical potential as the preceding zone, said auxiliary electrodes collectively having a second effective surface area which is at least as great as about said first surface area;

a power supply for establishing said potentials and inducing current flow between said electrodes and said substrate;

conductor means electrically coupling said power supply, said substrate, and said electrodes;

first diode means electrically intermediate each said primary electrode of said preceding zones and said power supply for preventing current flow between each of said electrodes within the same said array through said conducting means; and second diode means electrically intermediate each said auxiliary electrode and said power supply means for preventing flow of current from one auxiliary electrode to the other auxiliary electrodes via said connector means.

11. Apparatus according to claim 10 wherein said substrate is cathodic relative to said zones.

* * * * *